US011420864B2

(12) United States Patent
Ganthaler et al.

(10) Patent No.: US 11,420,864 B2
(45) Date of Patent: Aug. 23, 2022

(54) FILLING HEADS

(71) Applicant: Röchling Automotive SE & Co. KG, Mannheim (DE)

(72) Inventors: Christoph Ganthaler, Naturns (IT); Dieter Kerschbaumer, Tramin (IT)

(73) Assignee: Röchling Automotive SE & Co. KG, Mannheim (DE)

( * ) Notice: Subject to any disclaimer, the term of this patent is extended or adjusted under 35 U.S.C. 154(b) by 0 days.

(21) Appl. No.: 17/465,893

(22) Filed: Sep. 3, 2021

(65) Prior Publication Data

US 2022/0073339 A1 Mar. 10, 2022

(30) Foreign Application Priority Data

Sep. 7, 2020 (DE) ..... 10 2020 123 321.3

(51) Int. Cl.
*B67D 7/54* (2010.01)
*B67D 7/04* (2010.01)

(52) U.S. Cl.
CPC ..... *B67D 7/54* (2013.01); *B67D 7/0478* (2013.01)

(58) Field of Classification Search
CPC ..... B67D 7/0476; B67D 7/048; B67D 7/54; B65B 3/18; B60K 15/04
(Continued)

(56) References Cited

U.S. PATENT DOCUMENTS 5,271,438 A * 12/1993 Griffin ..... B60K 15/04 141/351
5,730,194 A * 3/1998 Foltz ..... B60K 15/04 141/308

(Continued)

FOREIGN PATENT DOCUMENTS

DE 102014010989 A1 2/2016
EP 2719566 A1 4/2014
EP 2665901 B1 11/2014

OTHER PUBLICATIONS

German Search Report for corresponding DE 10 2020 123 321.3 dated Jun. 18, 2021, 9 pgs.

(Continued)

*Primary Examiner* — Timothy L Maust
(74) *Attorney, Agent, or Firm* — Rankin, Hill & Clark LLP

(57) ABSTRACT

A filling head, which includes:

A filling head housing for conveying operating fluid in a supply sense from a supply-intake region, which is configured for introducing operating fluid into the filling head, to an outlet port, A venting structure which allows the conveying of gas in a venting sense which is opposite to the supply sense, Where the supply-intake region exhibits a hollow plug-in connector extending along a virtual nozzle path with a plug-in orifice through which an intake space connected fluid-mechanically with the outlet port is accessible, Where an inner nozzle wall bordering the intake space exhibits functional formations projecting into the intake space as part of the venting structure, Where on the external side of the plug-in connectors there is provided an active formation which is configured to interact with an internal thread of a supply device for the latter's positional stabilization at the plug-in connector.

The filling head provides that the active formation reaches along the nozzle path up to a main body of the filling head housing, from which the plug-in connector projects.

20 Claims, 6 Drawing Sheets

(58) Field of Classification Search
USPC ..... 220/86.2; 141/59
See application file for complete search history.

(56) References Cited

U.S. PATENT DOCUMENTS

| | | | | |
|---|---|---|---|---|
| 8,096,332 | B2 * | 1/2012 | Hagano | B60K 15/04 141/285 |
| 9,539,898 | B2 * | 1/2017 | Netzer | B60K 15/077 |
| 9,776,502 | B2 | 10/2017 | Koukan et al. | |
| 9,849,775 | B2 * | 12/2017 | Eberhardt | B60K 15/035 |

OTHER PUBLICATIONS

Espacenet Bibliographic data:DE 102014010989 (A1), Published Jun. 4, 2016, 1 pg.
Espacenet Bibliographic data:EP 2665901 (B1), Published Nov. 5, 2014, 1 pg.
Espacenet Bibliographic data:EP 2719566 (A1), Published Apr. 16, 2014, 1 pg.
Norm ISO 22241-4 2019-07-00. Diesel engines—NOx reduction agent AUS 32—Part 4: refilling interface.
Norm ISO 22241-5 2019-07-00. Diesel engines—NOx reduction agent AUS 32—Part 5: refilling interface for passenger cars.

* cited by examiner

FILLING HEADS

This application claims priority in German Patent Application DE 10 2020 123 321.3 filed on Sep. 7, 2020, which is incorporated by reference herein.

The present invention concerns a filling head for introducing operating fluid into an operating fluid tank of a motorized vehicle and for venting the operating fluid tank during the introduction of operating fluid into it, as described in the preamble of claim 1.

BACKGROUND OF THE INVENTION

Such filling heads are known generally in automotive engineering. They serve in the case discussed here preferably for filling a urea tank with an aqueous urea solution. In principle, however, the operating fluid can be an arbitrary operating fluid of a motorized vehicle.

The filling head comprises a filling head housing for conveying operating fluid in a supply sense from a supply-intake region, which is configured for temporally provisional intake of a supply device, such as for instance a spigot or a reservoir container neck, for introducing operating fluid into the filling head, to an outlet port of the filling head housing, where the outlet port is arranged in the supply sense downstream of the supply-intake region.

The term 'supply sense' denotes, regardless of local flow directions of the operating fluid during a filling and/or supply process of an operating fluid tank or hereinafter also just for short 'tank' connected fluid-mechanically with the filling head, a resulting flow direction via the entire filling head from an inlet end further away from the tank on the completely assembled motorized vehicle to an outlet end of the filling head nearer to the tank. Due to the more or less complicated inner structure of a filling head, operating fluid conveyed through the filling head can flow locally in different flow directions at different locations. In the supply operation, during which operating fluid is filled at the motorized vehicle into the tank through the filling head, the operating fluid nevertheless always flows in the supply sense through the filling head.

The filling head further comprises a venting structure, which during the conveying of operating fluid through the filling head housing in the supply sense allows the conveying of gas in a venting sense which is opposite to the supply sense.

It is known generally that during the filling of a tank with fluid, the fluid introduced into the tank has to be able to displace gas originally present in the tank in order to achieve fault-free and proper complete filling of the tank. In the filled tank there remains unavoidably a gas volume above the filled operating fluid. The pressure of this gas should differ quantitatively only insignificantly from the atmospheric pressure. The filling of the tank with operating fluid and the venting of the gas displaced by the operating fluid naturally take place in counterflow, i.e. the operating fluid flows in the supply sense towards the tank whereas the displaced gas flows in the venting sense away from the tank. Once again, concrete local flow directions of the gas should not matter. For the 'venting sense', therefore, the statement made above regarding the supply sense applies mutatis mutandis: The venting sense indicates the resulting flow direction of the displaced gas via the entire filling head away from the tank.

As supply devices, there are known for example spigots, which at filling stations or generally at dispensing stations form the output section of a motorized conveying device which conveys the operating fluid from a large operating fluid reservoir whose capacity considerably exceeds the usable tank volume of a single vehicle. Further there are known as supply devices necks of reservoir containers, in particular of bottles and canisters, through which a defined manually manageable operating fluid reservoir can be emptied into the tank. As such a manually manageable operating fluid reservoir, whose capacity is usually less than or approximately equal to the usable tank volume of a motorized vehicle, there is known for example the Kruse bottle. In addition to the Kruse bottle, other bottles are also available on the market.

Since the supply devices, independently of the manufacturer, have to be able to fill a large number of operating fluid tanks of different vehicles, the supply devices are configured so as to be standardized in their dimensions, at least in terms of their end sections that have to interconnect with vehicles' filling heads. Shapes and dimensions of filling systems are defined in the ISO Standards 22241-4 and 22241-5.

Because of this standardization, it is permissible here to refer to these supply devices without them necessarily having to be defined in further detail or even be part of the technical solution described here, since due to the standardization the relevant average expert is familiar with their dimensions that are pertinent for filling heads.

The supply-intake region of the filling head exhibits a hollow plug-in connector with a plug-in orifice, extending along a virtual nozzle path. The virtual nozzle path is envisaged in the present case as passing centrally through the plug-in connector in the longitudinal direction. It defines therefore an axial direction of the plug-in connector and makes possible the definition of radial directions radiating out from the nozzle path and of circumferential directions proceeding around the nozzle path. The nozzle path can in principle be an arbitrary curvilinear path, where appropriate even curved multiple times. Preferably, however, the nozzle path is a straight-line nozzle axis.

An intake space for temporally provisional intake of the supply device is accessible through the end-side plug-in orifice of the plug-in connector. The intake space is connected with the outlet port fluid-mechanically, so that via the supply device accommodated in the intake space, operating fluid output by it can reach the outlet port and from there ultimately into the tank likewise connected with the filling head fluid-mechanically.

A nozzle wall radially bounding the intake space, relative to the nozzle path, exhibits functional formations arranged in a circumferential direction around the nozzle path, with spacing between one another and protruding into the intake space. These functional formations thus form projections which protrude from the inner nozzle wall into the intake space. Due to the spacing present between the functional formations, venting volumes are formed in a circumferential direction between the functional formations, which even with a supply device being accommodated in the intake space cannot be physically occupied, since the accommodated supply device normally abuts the radially inward facing surfaces of the functional formations. The functional formations are therefore part of the aforementioned venting structure.

On the external side of the plug-in connector there is provided an active formation, which is configured to interact with an internal thread of the supply device for the latter's positional stabilization at the plug-in connector. Spigots as supply devices usually do not exhibit an internal thread. State of the art reservoir containers, in particular bottles such as the widely used Kruse bottle, normally exhibit a coupling sleeve that surrounds the reservoir container neck and extends coaxially with the reservoir container neck, at the inside of which the internal thread is configured. State of the art plug-in connectors exhibit two or three turns of an external thread as the active formation. These state of the art plug-in connectors permit a detachable screwed engagement between the internal thread of the coupling sleeve and the external thread of the plug-in connector as positional securing of the reservoir container at the plug-in connector for the duration of a supply process.

Generic filling heads are known for example from DE 10 2013 016 684 A, EP 2 668 055, or EP 2 719 566 A. In all these known filling heads, the active formation is formed by the aforementioned external thread, which is configured for screwed engagement with the internal thread of the supply device. The external thread extends only over a few turns, normally no more than three turns.

SUMMARY OF THE INVENTION

It is the task of the present invention to improve the known filling heads.

This task is solved by the present invention of a generic filling head by having the active formation reach along the nozzle path up to a main body of the filling head housing, from which the plug-in connector projects.

By configuring the active formation up to the main body of the filling head housing, the active formation extends not only, as in the state of the art, over a longitudinal section of the plug-in connector located at a distance from the main body of the filling head housing, but rather extends away and starting from the main body of the filling head housing. As a result, on the one hand the plug-in connector can be stiffened, since compared with the state of the art, the active formation being lengthened up to the main body of the filling head housing increases the bending stiffness of the plug-in connector and thus its robustness in proper supply operation.

On the other hand, a longer section of the active formation than is the case thus far in the state of the art proceeding along the nozzle path, can be used for coupling the plug-in connector with the supply device. Thereby, either the coupling reliability can be increased or, by utilizing the greater axial length of the active formation compared with the state of the art, a simpler, in particular more simply manufacturable and detachable, but with regard to the positional stabilization of the supply device equally effective coupling of the supply device with the filling head, can be realized.

Preferably the active formation extends along the nozzle path over more than 70%, preferably over more than 75%, especially preferably over 80% or more, of the length of the plug-in connector from the main body of the filling head housing to the plug-in orifice.

For an especially secure coupling of the plug-in connector with the supply device, in particular with the known coupling sleeve of a reservoir container, in accordance with a first aspect of the present invention the active formation can comprise an external thread. The external thread then proceeds up to the main body of the filling head housing. Consequently, more turns are available than up to now in the prior art for the screwed engagement with a known internal thread of a supply device. Admittedly, usually a thread carries no more than two turns in a screwed engagement. However, the components involved in the screwed engagement considered here are synthetic injection molded components with a comparatively high shape and mass variability between different production lots. If more turns are available for the screwed engagement, for example four or more turns, there is a higher likelihood that at least one turn of the external thread and internal thread fit each other optimally than is the case with a smaller number of turns.

Over and above that, with the external thread extended up to the main body, new coupling components such as for instance adapters that exhibit longer internal threads with a larger number of turns can be coupled detachably with the plug-in connector firmly and reliably.

In principle, the external thread can be configured so as to proceed helically completely around the nozzle path. In the event that at least one section of the external side of the plug-in connector is to be used for further functions, the external thread can be configured to be discontinuous in at least one angular sector around the nozzle path. In said angular sector, the radial dimension of the external thread can be reduced to the extent that the external thread no longer comes in meshing engagement with the internal thread of the supply device in said angular sector. Preferably the at least one angular sector is free from an external thread formation. In said angular sector, another formation can then be configured as the external thread or the angular sector recessed from the external thread can be used for conveying a fluid.

In accordance with a second aspect of the present invention, which can be realized additionally or alternatively to the first aspect, the active formation can comprise at least one longitudinal rib extending along the nozzle path, jutting out radially from the plug-in connector. The longitudinal rib can be configured for example as a stiffening rib in the aforementioned angular sector that is free from an external thread. Preferably the radial dimension of the longitudinal rib, in order to prevent undesirable fouling with the internal thread, is such that the distance of its radially outermost surface from the nozzle path is no greater than an inner radius of the internal thread.

Preferably the active formation comprises a plurality of longitudinal ribs arranged in a circumferential direction around the nozzle path at a distance from one another. The longitudinal ribs are preferably configured in their radial dimensions such that a virtual cylindrical or conical envelope, which touches tangentially the radially outward-facing rear faces of the longitudinal ribs, and whose cylinder or cone axis respectively coincides with the section of the nozzle path extending along the longitudinal ribs, over at least half of the longitudinal extension of the longitudinal ribs is no greater, furthermore preferably in order to prevent unnecessarily large free play is no smaller than by 0.75 mm, than the inner diameter of the internal thread of the supply device. To wit, then the internal thread of the supply device can be slid translationally without screw movement over the longitudinal ribs, where the rear faces of the longitudinal ribs center the supply device via its internal thread. Due to the extension of the longitudinal ribs up to the main body of the filling head housing, a sufficiently large overlap length can be produced between the internal thread and the longitudinal ribs, such that the supply device with the internal thread can be pushed onto the plug-in connector for the duration of the supply process in a tilt-proof manner.

For this purpose there are preferably provided at least three longitudinal ribs parallel to one another, where the longitudinal ribs are preferably arranged equidistant to one another in a circumferential direction around the nozzle path. According to an advantageous further development of the invention, the number of longitudinal ribs is greater than three, where with an increasing number of longitudinal ribs the security against tipping over of the merely pushed-on internal thread is increased.

Alternatively or additionally, according to a third aspect of the present invention the active formation can exhibit at least one outer wall section of the plug-in connector. The outer wall section too is so designed that a virtual cylindrical or conical envelope touching it tangentially, whose cylinder or cone axis respectively coincides with a section of the nozzle path proceeding along the outer wall section, over at least half of the longitudinal extension of the outer wall section along the nozzle path is not greater than the inner diameter of the internal thread of the supply device, furthermore preferably in order to prevent unnecessarily large free play is not smaller than the inner diameter by more than 0.75 mm.

The virtual conical envelopes mentioned in the present application exhibit preferably a conical angle which corresponds to a draft angle in injection molding tools, for example a cone angle of between 2° and 4°. Other cone angles are however conceivable. A virtual conical envelope tapers towards the plug-in orifice.

For an advantageous position definition of the internal thread of the supply device at the outer wall section of the plug-in connector, the active formation can exhibit a plurality of outer wall sections following one another in a circumferential direction but spatially separated from one another. Especially preferably, the outer wall section is closed and proceeds completely around the nozzle path. In this case, the outer wall section exhibits an outer diameter which at least is not greater, and preferably not smaller by more than 0.75 mm, than the inner diameter of the supply device.

In the event that the outer wall section is configured with an increased outer diameter compared with the state of the art, the increased outer diameter can be achieved either by means of increased wall thickness, which stiffens the plug-in connector additionally, or alternatively the increased outer diameter can at least section-wise make possible an increased inner diameter, which facilitates the venting of the displaced gas through an annular gap formed between the outer diameter of a supply device plugged into the plug-in connector and the inner wall of the plug-in connector due to the increased gap volume.

Through the use of longitudinal ribs and/or of the outer wall section and the in principle axially longer active formation, the supply device with internal thread can be pushed onto the plug-in connector faster than has been the case thus far with nearly the same connection reliability. Any screw movement thus far needed for coupling the supply device with the plug-in connector can be dispensed with. For this purpose it is advantageous if the active formation exhibits an outer surface facing away radially from the nozzle path, which is configured as a sliding surface for sliding abutting contact with a boundary surface of the internal thread. The outer surface of the active formation is therefore preferably smooth along the nozzle path and step-free.

Although the three aforementioned different designs of the active formation can be realized as combination of two or even of all three designs: external thread, at least one longitudinal rib, and outer wall section, an externally thread-free design of an active formation as at least one longitudinal rib and/or as an outer surface section is preferable in order to make possible coupling of the internal thread with the plug-in connector only through a translational movement along the nozzle path.

In order to guarantee the imperviousness of the plug-in connector, a sealing formation can be arranged on the external side of the plug-in connector along the nozzle path at a distance from the plug-in orifice. The sealing formation can be injected in a two-component injection molding process at the plug-in connector. Preferably the sealing formation is accommodated as a separate sealing component, for instance as a O-ring, at the plug-in connector, for instance in a specifically configured groove proceeding around the nozzle path. The sealing formation can seal with respect to the component carrying the internal thread of the supply device, for instance the already mentioned coupling sleeve, and/or with respect to a lid covering the plug-in orifice between supply processes.

In order to make sure that the sealing formation and the active formation do not obstruct each other functionally, preferably the sealing formation is arranged along the nozzle path between the plug-in orifice and the active formation.

In principle, the aforementioned functional formations projecting from the inner wall of the plug-in connector radially inwards into the intake space can perform exclusively a function of flow routing of the displaced gas during venting, for instance as ribs jutting out from the inner wall.

Often in the state of the art, the external thread configured for coupling with supply devices at the plug-in connector is also used for attaching a lid for closing the plug-in orifice between supply processes. The present invention permits plug-in connectors without an external thread. In order to make possible, regardless of the external shape of the plug-in connector, a secure arrangement of a lid on a filling head formed with the smallest possible number of components, the functional formations can form a control gate with a bayonet contour, where the control gate exhibits an insertion gate section located nearer to the plug-in orifice and locking gate section located further away from the plug-in orifice and extending more in a circumferential direction around the nozzle path than along the nozzle path, where the insertion gate section extends further along the nozzle path than does the locking gate section.

Then it suffices if the lid exhibits a cam projecting radially outwards, which can exhibit sliding motion along the control gate. The insertion gate section allows the defined arrangement of the lid cam after setting the lid onto the plug-in orifice of the plug-in connector and allows, for instance by means of rotary movement of the lid about the nozzle path, deliberate movement of the lid cam into the locking gate section, where the lid cam preferably abuts the locking gate section in a self-locking manner. In addition, the locking gate section can exhibit a rest lug, which can be overcome by the lid cam in order to secure the lid against unintentional, automatic opening or lifting respectively.

The insertion gate section extends over a larger region along the nozzle path than the locking gate section, since it is the task of the former section to bring a lid cam to the locking gate section regardless of the setting situation of the lid during setting onto the plug-in orifice, and it is the task of the latter section to secure the lid by means of the lid cam at the plug-in connector against lifting off same.

The advantage of using a control gate with a bayonet contour, i.e. a bayonet lock, compared with a screw thread, consists in the fact that volumes present between the functional formations in a circumferential direction can be used for venting, which normally is not possible or only possible to a significantly smaller extent with a thread surrounding the nozzle path completely.

In order to indicate to the user a defined end position of the lid, the control gate can exhibit a stop section which as a mechanical end stop aligns at the locking gate section with a cam guided along the control gate in such a way that the locking gate section is situated between the insertion gate section and the stop section. The user then receives a tactile feedback that he has positioned the lid completely and correctly at the plug-in connector.

For better guiding of the supply device in the intake space and for improved flow routing of displaced gas, which during a supply process flows between the functional devices in the venting sense, the stop section can proceed along the nozzle path in the supply sense at least up to the end of the active formation.

In contrast to the bottles or generally reservoir containers discussed above as operating fluid reservoirs and their necks as supply devices, spigots as supply devices usually exhibit a magnetic field-sensitive valve, which in the normal state is closed and only by means of a magnetic field acting on it can be switched into an open state that allows the conveying of operating fluid. In order to also make possible with the filling head discussed here a supply process with such a spigot, preferably a magnet arrangement is arranged in the main body of the filling head housing following the plug-in connector in the supply sense along the nozzle path, whose magnetic field acts in an operating fluid supply route configured in the filling head. The magnet arrangement has to be arranged along the nozzle path and/or along the supply route respectively at a location that makes possible action of the magnetic field generated by the magnet arrangement on a magnetic field-sensitive valve in a spigot plugged into the intake space. Preferably the magnet arrangement is an annular magnet, where the supply route passes through the annular magnet. Alternatively, the magnet arrangement can exhibit at least two or more magnets arranged around the supply route. Preferably the magnet arrangement comprises only permanent magnets, in order to avoid a power supply to the filling head for energizing an electromagnet.

Due to its complexity, preferably the filling head housing is fitted together out of several housing components. Preferably the individual housing components are made by injection molding out of a thermoplastic synthetic, preferably filled to increase its strength, and fitted together by plastic welding. An especially stable plug-in connector projecting away from the main body of the filling head housing can be obtained by configuring the plug-in connector integrally with an end section of the main body of the filling head housing.

Facilitated fitting of the magnet arrangement in the filling head housing can be realized by accommodating the magnet arrangement in the integral housing component exhibiting the plug-in connector and the end section of the main body of the filling head housing. For example, the magnet arrangement can be simply inserted or placed in an appropriate cavity or recess in the housing component on the side of the housing component facing away from the plug-in connector. The magnet arrangement can be cemented or molded with the housing component. On the side of the housing component facing away from the plug-in connector there can be configured clamping formations, such as for instance longitudinal ribs protruding radially inward and proceeding in the housing component in the plug-in direction of the magnet arrangement, between which the magnet arrangement is frictionally engaged.

In order to be able to discharge the displaced gas created during a supply process, which in the here preferred case of an aqueous urea solution as the operating fluid takes place with a volume flow of approximately 40 l/min, as completely as possible to the external environment of the filling head, the filling head preferably exhibits as part of the venting structure a venting line, which at least section-wise is configured as spatially separate from the main volume of the filling head housing through which operating fluid flows in the supply sense during the supply operation. In order to achieve a compact filling head, it is preferable for the venting line to discharge into the main volume of the filling head housing. The discharge of the venting line into the main volume of the filling head housing takes place normally on the side of the magnet arrangement facing away from the plug-in connector, such that the gas displaced into the main volume can flow through the gap volume formed between the supply device and the inner wall of the plug-in connector and finally through the plug-in orifice into the external environment.

In principle, the venting line can be configured as separate from the filling head housing. For a compact filling head shape and to prevent misconnections, the filling head housing can exhibit at least one integral housing component, which forms part of the main body of the filling head housing and in which there is configured both at least one part of the main volume of the filling head housing and at least one part of the venting line. Preferably the housing component, likewise made by plastic injection molding, exhibits the discharge point of the venting line into the main volume of the filling head housing.

In order to realize a spatially compact filling head, the filling head housing can exhibit more than one integral housing component, of which every housing component forms part of the main body of the filling head housing and in every one of which both at least one part of the main volume of the filling head housing and at least one part of the venting line is configured.

These and other objects, aspects, features and advantages of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which forms a part hereof and wherein.

DESCRIPTION OF PREFERRED EMBODIMENTS

Figure 1:
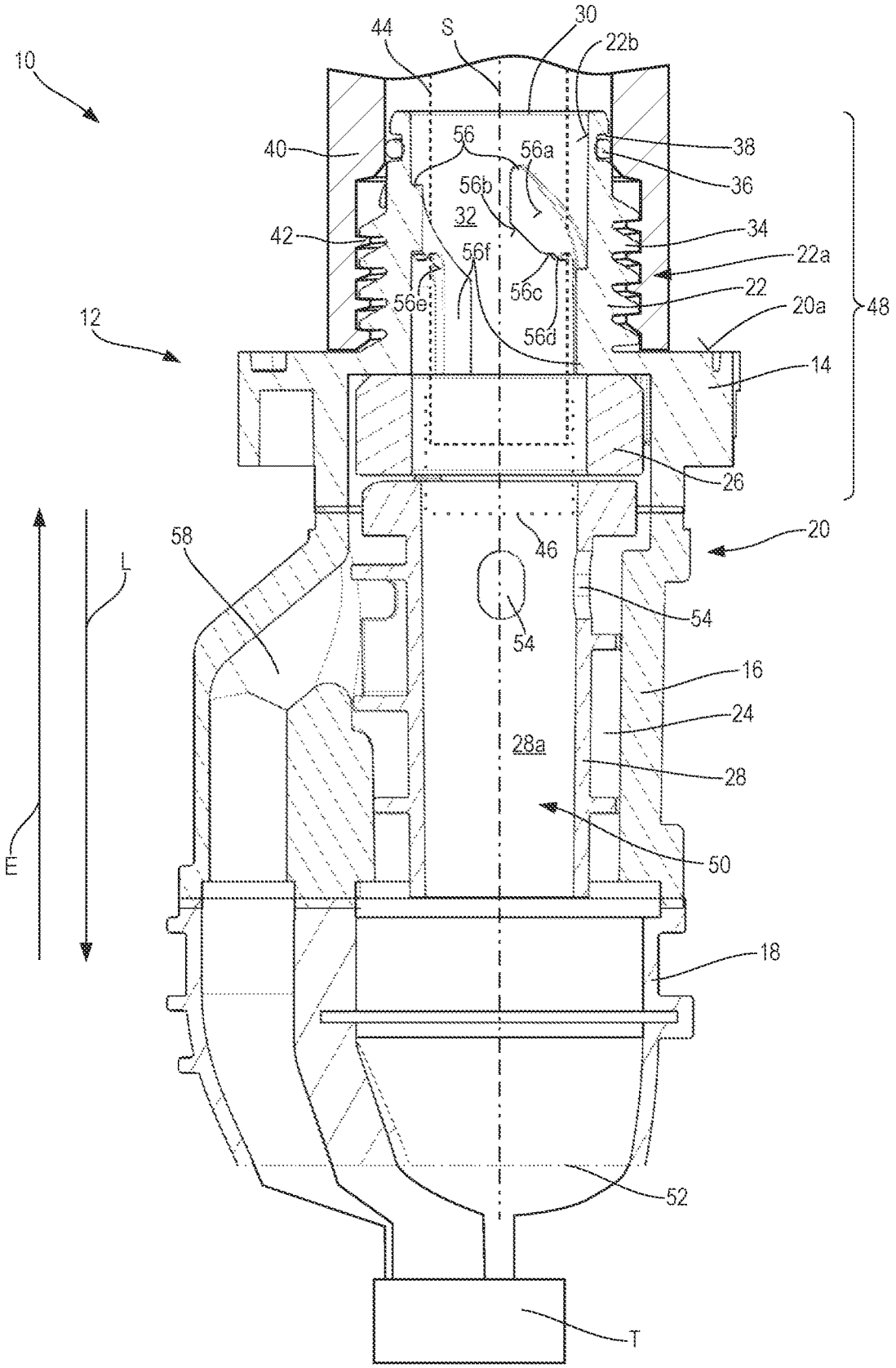
FIG. 1 A longitudinal section of a first embodiment of the invention's filling head of the present application, FIG. 2 A perspective view of the filling head of the first embodiment of FIG. 1, FIG. 3 A longitudinal section of a second embodiment of the invention's filling head of the present application, FIG. 4 A perspective view of the filling head of the second embodiment of FIG. 2, FIG. 5 A longitudinal section of a third embodiment of the invention's filling head of the present application, and FIG. 6 A perspective view of the filling head of the third embodiment of FIG. 3.
Figure 2:
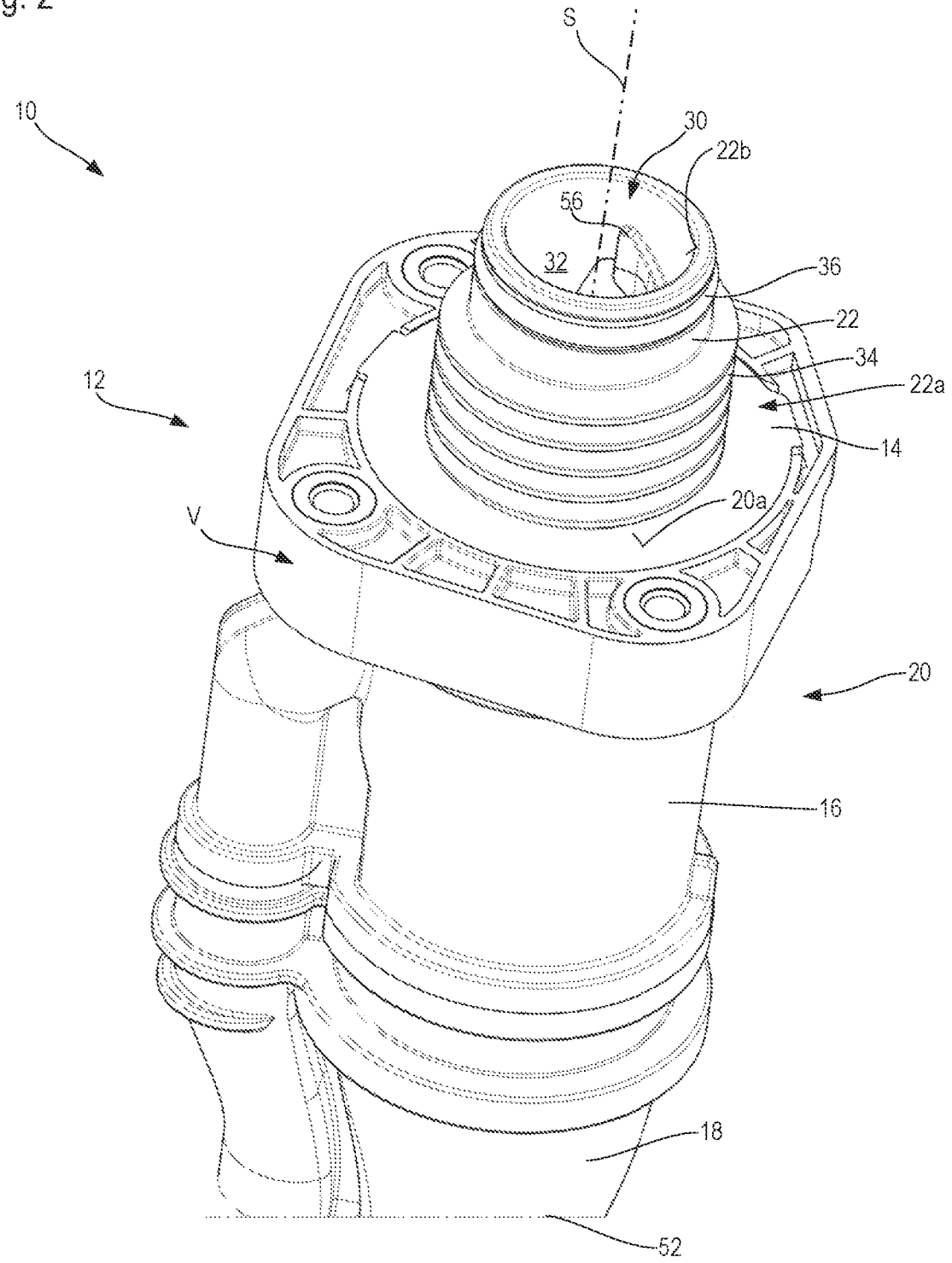

Referring now to the drawings wherein the showings are for the purpose of illustrating preferred and alternative embodiments of the invention only and not for the purpose of limiting the same, in FIGS. 1 and 2, a first embodiment of a filling head of the present application is labelled generally with 10. The filling head exhibits a filling head housing 12, which in the present example is formed from three housing components 14, 16, and 18 fitted together. The housing components 14, 16, and 18 are made from a thermoplastic synthetic by injection molding and welded together at their connecting regions facing towards one another. The synthetic of at least one housing component 14, 16, and 18, preferably of all housing components 14, 16, and 18, is filled, for example with glass fibers, in order to increase the strength of the carbon and thus of the respective housing component.

The filling head housing 12 exhibits a main body 20, from which a plug-in connector 22 protrudes along a virtual nozzle path S forming a straight nozzle axis. The main body 20 surrounds a main volume 24 of the filling head housing 12. In the main volume 24 there is arranged at the inlet-side end a preferably annular magnet arrangement 26. In the main volume 24 there is arranged on the side of the magnet arrangement 26 that is nearer the tank during operation a flowline component 28.

The plug-in connector 22 exhibits a plug-in orifice 30, through which an intake space 32 surrounded radially outside both by the plug-in connector 22 and by the magnet arrangement 26 is accessible from outside.

The plug-in connector 22 of the first embodiment exhibits at its external side 22*a* which faces away from the intake space 32 an external thread 34 as an active formation, which starting from an end face 20*a*, which forms a longitudinal end further away from the tank of the main body 20 of the filling head housing 12, extends over approximately three fourth of the length of the plug-in connector 22.

Between the end of the external thread 34 nearest to the plug-in orifice 30 and the plug-in orifice 30 itself there is arranged on the external side 22*a* of the plug-in connector 22 a sealing arrangement 36 in the shape for example of an O-ring in a groove 38 provided for same. The sealing arrangement 36 seals between supply processes against a lid not depicted in drawings, which is arranged detachably for covering the plug-in orifice 30 at the free longitudinal end of the plug-in connector 22.

For the sake of better understanding, FIG. 1 depicts a coupling sleeve 40 with an internal thread 42 configured in it with the external thread 34 bolted in place. The coupling sleeve 40 is part of a reservoir container neck to be emptied manually through the filling head 10. A ready for delivery neck 44 of the reservoir container, to which the coupling sleeve 40 also belongs, is indicated in FIG. 1 in rough schematic form by a dashed line in the intake space 32.

A ready for delivery spigot 46 as one possible supply device arranged in the intake space 32 is depicted by a dotted line in rough schematic form as a further possible supply device in comparison with the ready-for-delivery neck 44. The spigot 46 extends along the nozzle path S from the plug-in orifice 30 beyond the axial position of the magnet arrangement 26, such that it is made sure that the magnetic field produced by the magnet arrangement 26 can act on a valve device arranged in the spigot 46, in order to open it automatically for the passage of operating fluid under proper arrangement of the spigot 46 in the supply-intake region 48 of the filling head 10. Obviously, only either a neck 44 or a spigot 46 can be accommodated in the intake space 32 at the same time.

Quite fundamentally, the intake space 32 and the main volume 24 define a supply route 50 inside the filling head 10, through which during a supply process there flows operating fluid, which is released from a ready for delivery supply device 44 or 46, in the supply sense L in the direction from the plug-in orifice 30 towards the outlet port 52. Gas displaced during the supply process by the operating fluid flowing in the supply sense L from the tank T connected to the filling head 10, in contrast, flows through the filling head 10, i.e. the main volume 24 and the intake space 32, in a venting sense E opposite to the supply sense L. Merely for the sake of completeness, the tank T is depicted in rough schematic form only in FIG. 1.

The flowline component 28 following the magnet arrangement 26 in the supply sense L serves particularly for conveying in the supply sense L through the filling head 10 operating fluid released by the supply device 44 or 46. However, the flowline component 28 exhibits apertures 54 penetrating through the flowline component 28 for venting the tank T connected fluid-mechanically with the filling head 10, such that sections of the main volume 24 outside the flowline component 28 can also be reached by operating fluid during a supply process and consequently are part of the supply route 50.

The inner wall 22*b* of the plug-in connector 22 facing towards the intake space 32 exhibits a plurality of essentially identical functional formations 56 arranged in a circumferential direction around the nozzle path S at a distance from one another. The functional formations 56 are, as is also the external thread 34, configured integrally with the plug-in connector 22. In the present embodiment example, three functional formations 56 are provided each of which protrude away from the inner wall 22*b* radially inwards towards the nozzle path S.

End faces 56*a* of the functional formations 56 facing radially inwards towards the nozzle path S form contact surfaces for supply devices introduced into the intake space 32, in particular for a spigot 46, which unlike the neck 44 usually is not positionally stabilized via the external side 22*a* of the plug-in connector 22 in the latter.

In the space in a circumferential direction between two functional formations 56 there is consequently always made available a venting volume, through which gas can flow through the plug-in connector 22 in the venting sense E from the tank T connected with the filling head 10 to the plug-in orifice 30 and beyond it. Even when a supply device is introduced into the intake space 32, this flow space is retained radially outside the supply device between two functional formations 56 arranged at a distance from one another in a circumferential direction.

A marginal section of the functional formations 56 is configured as a control gate for locking a lid at the plug-in connector 22. The control gate is configured to form a bayonet lock with a cam sliding along it of the lid which is not depicted in the drawings. For this purpose, the control gate exhibits an insertion gate section 56*b* first proceeding solely axially in an initial region, then proceeding axially and in a circumferential direction, and exhibits a locking gate section 56*c* directly joining the insertion gate section 56*b* and proceeding essentially in a circumferential direction. The locking gate section 56*c* can exhibit a rest lug 56*d* that is overridable by the cam of the lid, in order to form with the cam a latching engagement which secures the lid at the plug-in connector 22 beyond the frictional engagement between the cam and the locking gate section 56*c*.

At the longitudinal end of the locking gate section 56*c* opposite to the insertion gate section 56*b* there is formed a stop section 56*e*. The latter proceeds essentially axially along the nozzle path S and forms a physical barrier for the cam abutting the locking gate section 56*c*. The region 56*f* of the functional formations 56 forming the stop section 56*e* is lengthened up to the magnet arrangement 26 as a longitudinal rib projecting radially from the inner wall 22*a* and extending axially along the nozzle path S. This region 56*f* serves on the one hand for positional stabilization of a supply device introduced into the intake space 32, in particular a spigot 46, and on the other for guiding a gas flow for venting through the inlet connector 22.

In each of the preferably integral housing components 16 and 18 there is configured a section of a venting line 58. These housing components thus each exhibit a section of the venting line 58 and a section of the main volume 24. In the housing component 16, the venting line 58 discharges into the main volume 24. Through the apertures 54 in the flowline component 28, displaced gas flowing into the main volume 24 via the venting line 58 can travel into the interior flow volume 28*a* of the flowline component 28 and from there through the annular magnet arrangement 26 into the intake space 32 of the plug-in connector 22 and through the plug-in orifice 30 finally out into the external environment.

Figure 3:
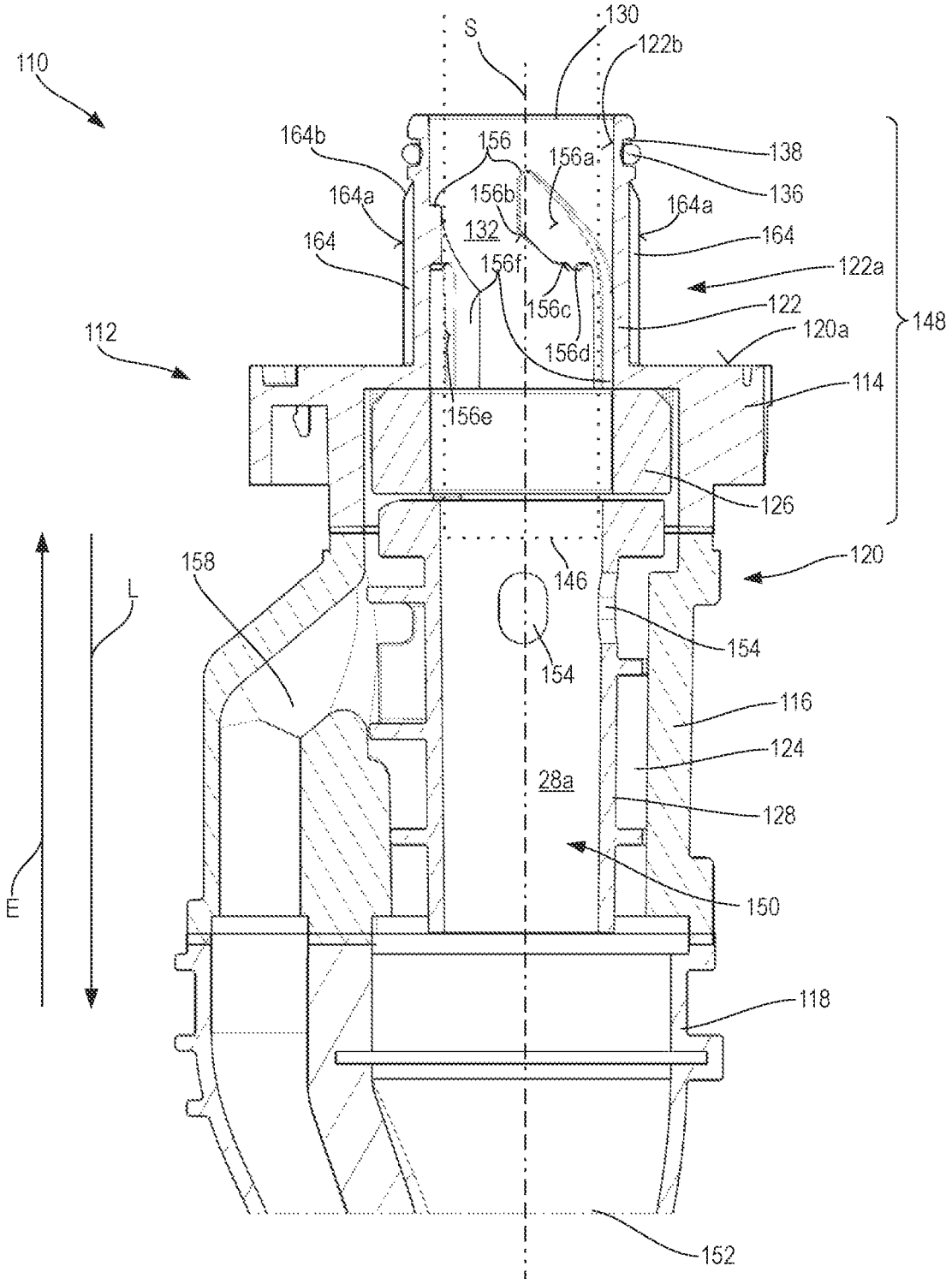
Figure 4:
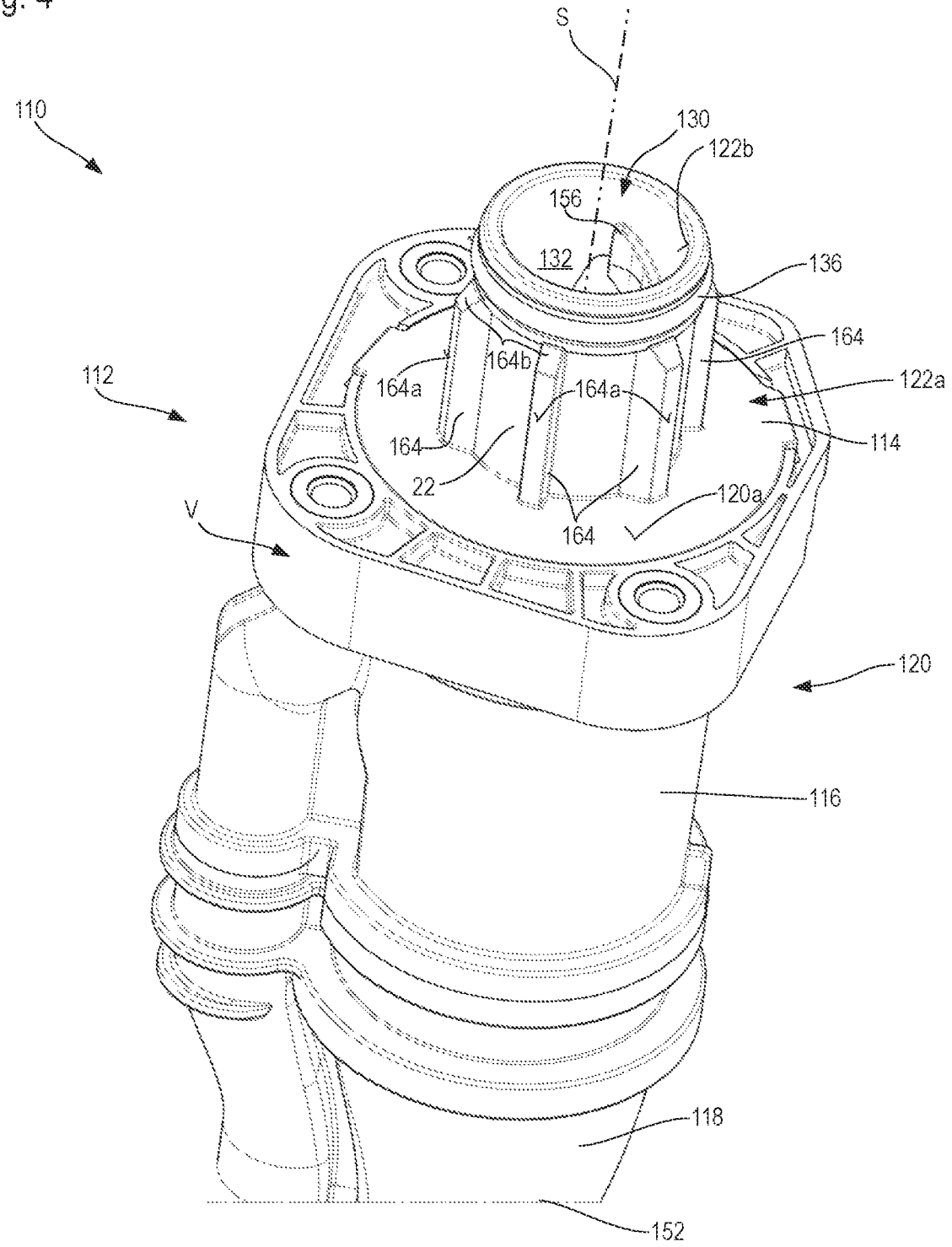

FIGS. 3 and 4 depict a second embodiment of the invention's filling head 110 of the present application in longitudinal section (FIG. 3) and in perspective view (FIG. 4).

Identical and functionally identical components and component sections as in the first embodiment are labelled in the second embodiment with the same reference labels, but increased numerically by 100. The second embodiment is described hereunder only in so far as it differs from the first embodiment, to whose description otherwise express reference is made also for elucidating the second embodiment.

For the sake of improved clarity, the coupling sleeve of the reservoir container is not shown in FIG. 3. Due to its standardized shape, however, this is unnecessary. The internal thread of the coupling sleeve looks in the second embodiment the same as in the first embodiment.

In contrast to the first embodiment, the filling head 110 of the second embodiment exhibits at its external side 122*a* no external thread but rather a plurality of longitudinal ribs 164. The longitudinal ribs 164 are so designed that a virtual cylindrical or slightly conical envelope, whose cylinder or cone axis respectively coincides with the nozzle path S and which is conceived as abutting tangentially on rear faces 164*a* of the longitudinal ribs 164, over at least half of its longitudinal extension does not exhibit a larger diameter than the inner diameter of the internal thread of the coupling sleeve known from FIG. 1. The diameter of the envelopes can be slightly smaller than the inner diameter of the internal thread of the coupling sleeve, in order to facilitate translational sliding of the coupling sleeve, in particular of the internal thread, over the longitudinal ribs 164. In order to prevent excessive tipping over of the coupling sleeve which is merely slid onto the longitudinal ribs 164, preferably over at least half of the longitudinal extension of the longitudinal ribs 164 the diameter of the envelopes is not smaller by more than 0.75 mm than the inner diameter of the internal thread.

In order to facilitate the sliding of the internal thread of the coupling sleeve onto the longitudinal ribs 164—and also the sliding of the internal thread off the longitudinal ribs 164—the rear faces 164*a* facing radially away from the nozzle path S are smooth and step-free. In order to facilitate the demolding of the housing component 114 exhibiting the plug-in connector 22, the rear faces 164*a* of the longitudinal ribs 164 can exhibit a conical virtual envelope, whose cone axis coincides with the nozzle path S. The cone angle can correspond to a usual draft angle of between 2° and 4°. A virtual conical envelope tapers in the direction from the main body 120 of the filling head housing 112 towards the plug-in orifice 130.

In order to facilitate the sliding of the internal thread of the coupling sleeve onto the longitudinal ribs 164, the longitudinal ribs 164 can exhibit insertion chamfers 164*b* at their longitudinal end located away from the main body 120. These insertion chamfers 164*b* are surfaces which are tilted relative to the nozzle path S about tilt axes orthogonal to the nozzle path S in such a way that the margin of an insertion chamfer 164*b* that is further away from the main body 120 along the nozzle path S is nearer to the nozzle path S than its opposite margin along the nozzle path S that is nearer to the main body 120.

Preferably, the longitudinal ribs 164 are arranged around the nozzle path S at an equidistant angular spacing, although this is not mandatory. The longitudinal ribs 164 likewise are preferably configured identically, although for example they can also exhibit differing circumferential dimensions.

When the internal thread of a coupling sleeve is slid translationally onto the plug-in connector 122, the radially inner end regions of the internal thread of the coupling sleeve end up abutting onto the rear faces 164*a* of the longitudinal ribs 164 and are centered by means of the longitudinal ribs 164. Three longitudinal ribs 164 are sufficient for centering. A higher number of longitudinal ribs 164 results in improved securing of the coupling sleeve against tipping over about a tipping axis orthogonal to the nozzle path S.

The longitudinal ribs 164 that reach up to the main body 120 also ensure stiffening of the plug-in connector 122, compared with a plug-in connector 122 with shorter longitudinal ribs which terminate at a distance from the main body 120, or compared with a plug-in connector 122 which exhibits only a few turns of an external thread where the external thread likewise ends at a distance from the main body 122.

Figure 5:
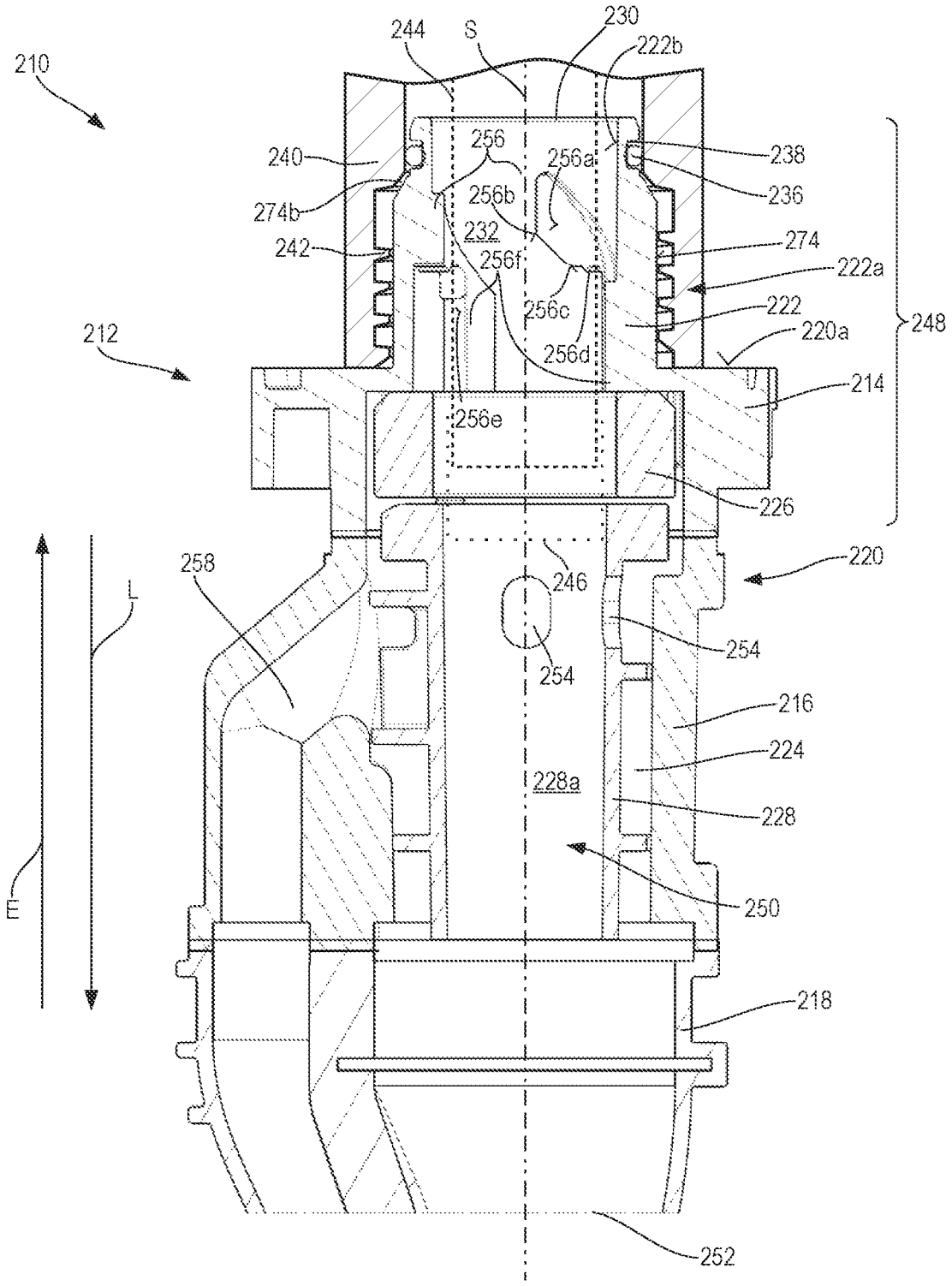
Figure 6:
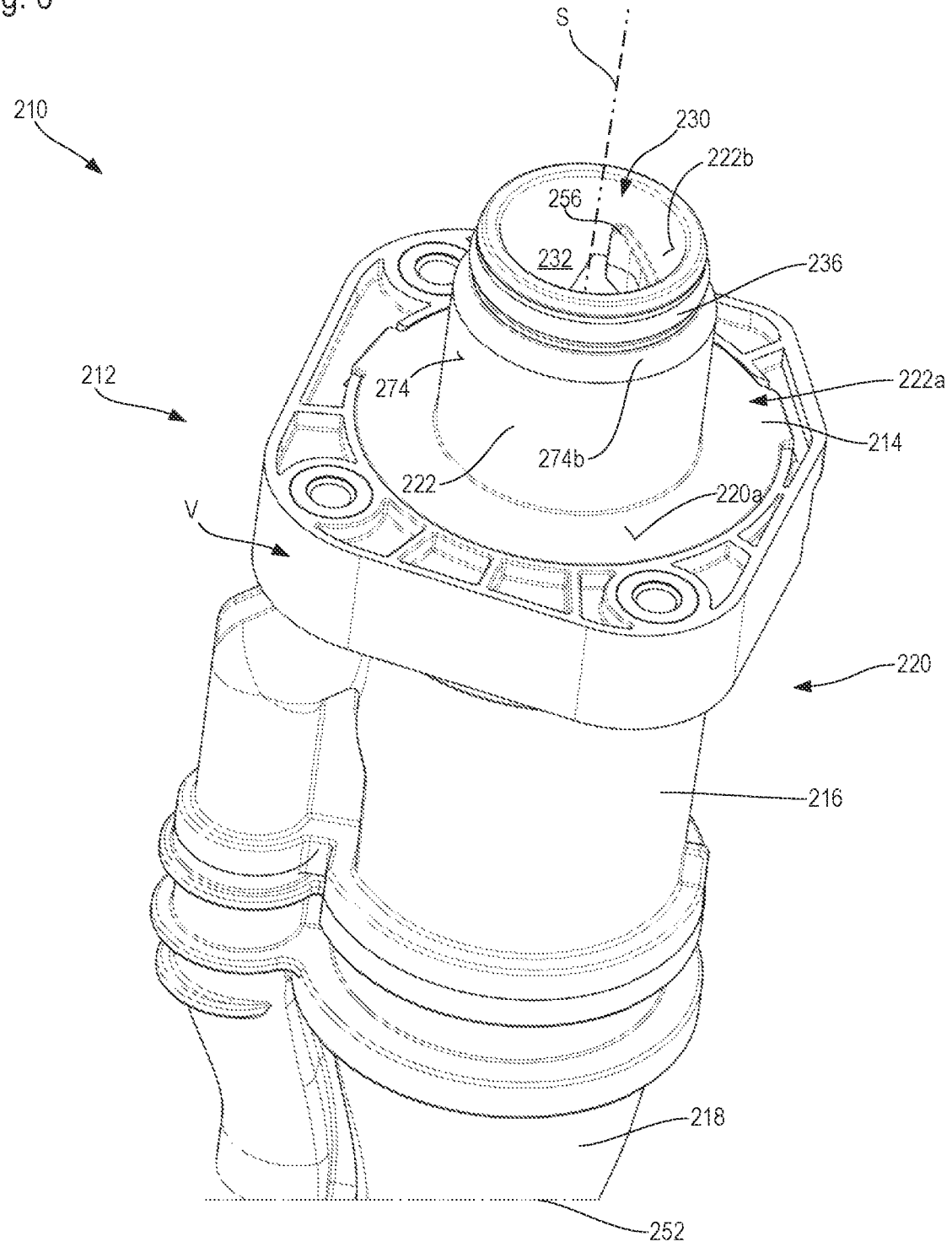

FIGS. 5 and 6 depict a third embodiment of the invention's filling head 210 of the present application in longitudinal section (FIG. 5) and in perspective view (FIG. 6). Once again it is the case that identical and functionally identical components and component sections as in the first embodiment exhibit in the third embodiment the same reference labels, but increased numerically by 200. Likewise, identical and functionally identical components and component sections as in the second embodiment are labelled in the third embodiment with the same reference labels, but increased numerically by 100.

The third embodiment is described hereunder only in so far as it differs from the first and from the second embodiment, to whose description otherwise express reference is made also for elucidating the third embodiment.

The third embodiment of the filling head 210 is functionally nearer to the second embodiment, since the active formation of the third embodiment also does not permit screwed engagement with the internal thread 242 of the coupling sleeve 240, but instead, like the second embodiment, low-backlash translational sliding on and sliding off of the coupling sleeve 240 onto the active formation or away from the active formation respectively.

The active formation of the third embodiment is formed by an outer wall section 274 of the plug-in connector 222. The outer wall section 274 forms part of the external side 222*a* of the plug-in connector 122 that is observable from outside.

The outer wall section 274 is closed and proceeds in a circumferential direction around the nozzle path S. The outer wall section 274 can, unlike the depicted embodiment, also be formed from several outer wall part-sections, of which each one extends only over a predefined angular region and between which are configured outer wall sections recessed towards the nozzle path S. The transition between segmented outer wall part-sections and a plurality of longitudinal ribs 164 is fluid.

The depiction of the coupling sleeve 240 of FIG. 5 that is slid onto the outer wall section 274 is also transferable to the second embodiment of FIG. 3. The internal thread 242 abuts against the outer wall section 274 with its radially inner surface regions.

Once again it is the case that the outer wall section exhibits an outer diameter which over at least half of the longitudinal extension of the outer wall section along the nozzle path S is not greater than the inner diameter of the internal thread 242. Preferably, to guarantee an only low level of free play and thereby low tipping tendency of the reservoir container pushed onto the filling head 210 by means of the coupling sleeve 240, the outer diameter of the outer wall section is smaller by not more than 0.75 mm than the inner diameter of the internal thread 142 of the coupling sleeve 240 over at least half of the longitudinal extension of the outer wall section.

The outer wall section can be cylindrical or conical. In the case of a conical outer wall section 274, it tapers in the direction from the main body 220 of the filling head housing 212 towards the plug-in orifice 230. The cone angle lies once again preferably within the range of usual draft angles, i.e. in particular between 2° and 4°, said angles included. The outer wall section 274 too is configured as smooth and step-free, in order to guarantee as far as possible the most undisturbed sliding-on and sliding-off movement of the coupling sleeve 240 onto the outer wall section 174 or away from it, respectively.

In the depiction shown in FIG. 5, the increased diameter of the outer wall section 274 of the plug-in connector 222 on the right-hand side of the plug-in connector 222 compared with the first two embodiments is formed by an increased wall thickness. Alternatively, the wall thickness of the plug-in connector 222 known from the first two embodiments can be retained and the intake space 232 increased radially, as is depicted on the left-hand side of the plug-in connector 222. The radial overhang dimension of the functional formations 256 relative to the nozzle path is then larger by the radial dimension increase of the functional formations 256. The venting through the plug-in connector 222 with a radially enlarged intake space 232 is improved because of the larger cross-section through which gas can flow.

In order to facilitate the sliding on of the coupling sleeve 240, the outer wall section 274 too can exhibit an insertion chamfer **274*b* tapering towards the plug-in orifice 230**.

In each of the perspective depictions of FIGS. 2, 4, and 6 there is depicted a component V which is part of the vehicle carrying the respective filling head 10, 110, and 210, but not of the filling head.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A filling head for introducing operating fluid into an operating fluid tank of a motorized vehicle and for venting the operating fluid tank during the introduction of operating fluid into it, where the filling head comprises:

A filling head housing for conveying operating fluid in a supply sense from a supply-intake region, which is configured for temporally provisional intake of a supply device, such as for instance a spigot or reservoir container neck, for introducing operating fluid into the filling head, to an outlet port of the filling head housing, where the outlet port is arranged in the supply sense downstream of the supply-intake region, A venting structure, which during the conveying of operating fluid through the filling head housing in the supply sense allows the conveying of gas in a venting sense which is opposite to the supply sense, Where the supply-intake region of the filling head exhibits a hollow plug-in connector extending along a virtual nozzle path with a plug-in orifice through which an intake space is accessible for temporally provisional intake of the supply device, where the intake space is connected fluid-mechanically with the outlet port, where an inner nozzle wall bordering the intake space radially relative to the nozzle path exhibits in a circumferential direction about the nozzle path functional formations arranged at a distance from one another and projecting into the intake space, such that the functional formations form between them in a circumferential direction venting volumes as part of the venting structure, where on an external side of the hollow plug-in connector there is provided an active formation which is configured so as to interact with an internal thread of the supply device for the latter's positional stabilization at the hollow plug-in connector, wherein the active formation reaches along the nozzle path up to a main body of the filling head housing, from which the hollow plug-in connector protrudes;

wherein the active formation further comprises an external thread, wherein the external thread is discontinuous in at least one angular sector around the nozzle path, such that the at least one angular sector is free from an external thread formation.

2. The filling head according to claim 1, wherein the active formation further comprises at least one longitudinal rib extending along the nozzle path and jutting out radially from the hollow plug-in connector.

3. The filling head according to claim 1, wherein the active formation exhibits at least one outer wall section, including an outer wall section surrounding the nozzle path completely, of the hollow plug-in connector.

4. The filling head according to claim 3, wherein the active formation exhibits an outer surface facing away radially from the nozzle path, which is configured as a sliding surface for a sliding abutting contact with a boundary surface of the internal thread.

5. The filling head according to claim 1, wherein the active formation exhibits an outer surface facing away radially from the nozzle path, which is configured as a sliding surface for a sliding abutting contact with a boundary surface of the internal thread.

6. The filling head according to claim 1, wherein on the external side of the hollow plug-in connector there is arranged a sealing formation along the nozzle path at a distance from the plug-in orifice.

7. The filling head according to claim 6, wherein the sealing formation is arranged along the nozzle path between the plug-in orifice and the active formation.

8. The filling head according to claim 1, wherein along the nozzle path following the hollow plug-in connector in the supply sense, there is arranged in the main body of the filling head housing a magnet arrangement whose magnetic field acts on an operating fluid supply route configured in the filling head.

9. The filling head according to claim 1, wherein the filling head housing is fitted together from several housing components, where the hollow plug-in connector with an end section of the main body of the filling head housing is configured integrally.

10. The filling head according to claim 1, wherein the filling head as part of the venting structure exhibits a venting line, which at least section-wise is configured as spatially separate from a main volume of the filling head housing through which operating fluid flows in the supply sense during the supply operation.

11. The filling head according to claim 10, wherein the venting line discharges into the main volume of the filling head housing.

12. The filling head according to claim 11, wherein the filling head housing exhibits at least one integral housing component, which forms part of the main body of the filling head housing and in which both at least one part of the main volume of the filling head housing and at least one part of the venting line are configured.

13. The filling head according to claim 10, wherein the filling head housing exhibits at least one integral housing component, which forms part of the main body of the filling head housing and in which both at least one part of the main volume of the filling head housing and at least one part of the venting line are configured.

14. The filling head according to claim 13, wherein the filling head housing exhibits more than one integral housing component, of which every housing component forms part of the main body of the filling head housing and in every one of which at least one part of the main volume of the filling head housing and also at least one part of the venting line are configured.

15. The filling head according to claim 2, wherein the at least one longitudinal rib extending along the nozzle path is a plurality of such longitudinal ribs arranged at a distance from one another in a circumferential direction around the nozzle path.

16. A filling head for introducing operating fluid into an operating fluid tank of a motorized vehicle and for venting the operating fluid tank during the introduction of operating fluid into it, where the filling head comprises:

A filling head housing for conveying operating fluid in a supply sense from a supply-intake region, which is configured for temporally provisional intake of a supply device, such as for instance a spigot or reservoir container neck, for introducing operating fluid into the filling head, to an outlet port of the filling head housing, where the outlet port is arranged in the supply sense downstream of the supply-intake region, A venting structure, which during the conveying of operating fluid through the filling head housing in the supply sense allows the conveying of gas in a venting sense which is opposite to the supply sense, Where the supply-intake region of the filling head exhibits a hollow plug-in connector extending along a virtual nozzle path with a plug-in orifice through which an intake space is accessible for temporally provisional intake of the supply device, where the intake space is connected fluid-mechanically with the outlet port, where an inner nozzle wall bordering the intake space radially relative to the nozzle path exhibits in a circumferential direction about the nozzle path functional formations arranged at a distance from one another and projecting into the intake space, such that the functional formations form between them in a circumferential direction venting volumes as part of the venting structure, where on an external side of the hollow plug-in connector there is provided an active formation which is configured so as to interact with an internal thread of the supply device for the latter's positional stabilization at the hollow plug-in connector, wherein the active formation reaches along the nozzle path up to a main body of the filling head housing, from which the hollow plug-in connector protrudes, wherein the active formation further comprises at least one longitudinal rib extending along the nozzle path and jutting out radially from the hollow plug-in connector.

17. The filling head according to claim 16, wherein the at least one longitudinal rib extending along the nozzle path is a plurality of such longitudinal ribs arranged at a distance from one another in a circumferential direction around the nozzle path.

18. A filling head for introducing operating fluid into an operating fluid tank of a motorized vehicle and for venting the operating fluid tank during the introduction of operating fluid into it, where the filling head comprises:

A filling head housing for conveying operating fluid in a supply sense from a supply-intake region, which is configured for temporally provisional intake of a supply device, such as for instance a spigot or reservoir container neck, for introducing operating fluid into the filling head, to an outlet port of the filling head housing, where the outlet port is arranged in the supply sense downstream of the supply-intake region, A venting structure, which during the conveying of operating fluid through the filling head housing in the supply sense allows the conveying of gas in a venting sense which is opposite to the supply sense, Where the supply-intake region of the filling head exhibits a hollow plug-in connector extending along a virtual nozzle path with a plug-in orifice through which an intake space is accessible for temporally provisional intake of the supply device, where the intake space is connected fluid-mechanically with the outlet port, where an inner nozzle wall bordering the intake space radially relative to the nozzle path exhibits in a circumferential direction about the nozzle path functional formations arranged at a distance from one another and projecting into the intake space, such that the functional formations form between them in a circumferential direction venting volumes as part of the venting structure, where on an external side of the hollow plug-in connector there is provided an active formation which is configured so as to interact with an internal thread of the supply device for the latter's positional stabilization at the hollow plug-in connector, wherein the active formation reaches along the nozzle path up to a main body of the filling head housing, from which the hollow plug-in connector protrudes, wherein the functional formations form a control gate with a bayonet contour, where the control gate exhibits an insertion gate section located nearer to the plug-in orifice;

and a locking gate section located further away from the plug-in orifice and extending more in a circumferential direction about the nozzle path than along the nozzle path, where the insertion gate section extends further along the nozzle path than does the locking gate section.

19. The filling head according to claim 18, wherein the control gate exhibits a stop section, which as a mechanical end stop of a cam guided along the control gate joins the locking gate section in such a way that the locking gate section is situated between the insertion gate section and the stop section, where the stop section proceeds along the nozzle path in the supply sense at least to the end of the active formation.

20. A filling head for introducing operating fluid into an operating fluid tank of a motorized vehicle and for venting the operating fluid tank during the introduction of operating fluid into it, where the filling head comprises:

A filling head housing for conveying operating fluid in a supply sense from a supply-intake region, which is configured for temporally provisional intake of a supply device, such as for instance a spigot or reservoir container neck, for introducing operating fluid into the filling head, to an outlet port of the filling head housing, where the outlet port is arranged in the supply sense downstream of the supply-intake region, A venting structure, which during the conveying of operating fluid through the filling head housing in the supply sense allows the conveying of gas in a venting sense which is opposite to the supply sense, Where the supply-intake region of the filling head exhibits a hollow plug-in connector extending along a virtual nozzle path with a plug-in orifice through which an intake space is accessible for temporally provisional intake of the supply device, where the intake space is connected fluid-mechanically with the outlet port, where an inner nozzle wall bordering the intake space radially relative to the nozzle path exhibits in a circumferential direction about the nozzle path functional formations arranged at a distance from one another and projecting into the intake space, such that the functional formations form between them in a circumferential direction venting volumes as part of the venting structure, where on an external side of the hollow plug-in connector there is provided an active formation which is configured so as to interact with an internal thread of the supply device for the latter's positional stabilization at the hollow plug-in connector, wherein the active formation reaches along the nozzle path up to a main body of the filling head housing, from which the hollow plug-in connector protrudes, wherein the filling head housing is fitted together from several housing components, where the hollow plug-in connector with an end section of the main body of the filling head housing is configured integrally, wherein a magnet arrangement is accommodated in the integral housing component exhibiting the hollow plug-in connector and the end section of the main body of the filling head housing.

* * * * *